US005771051A

United States Patent [19]

Guenther et al.

[11] Patent Number: 5,771,051

[45] Date of Patent: Jun. 23, 1998

[54] ARRANGEMENT FOR MONITORING FUNCTIONING OF AN INK PRINT HEAD

[75] Inventors: Stephan Guenther; Wolfgang Pekruhn, both of Berlin, Germany

[73] Assignee: Francotyp-Postalia AG & Co., Birkenwerder, Germany

[21] Appl. No.: 720,287

[22] Filed: Sep. 26, 1996

[30] Foreign Application Priority Data

Oct. 6, 1995 [DE] Germany ..... 195 37 161.5

[51] Int. Cl.[6] ..... B41J 29/38

[52] U.S. Cl. ..... 347/19; 347/14

[58] Field of Search ..... 347/19, 16, 23, 347/7, 14, 5; 358/504, 406

[56] References Cited

U.S. PATENT DOCUMENTS

| | | | |
|---|---|---|---|
| 4,145,697 | 3/1979 | Ballinger | 346/35 |
| 4,345,845 | 8/1982 | Bohnhoff et al. | 400/120 |
| 4,425,569 | 1/1984 | Kawanisi et al. | 346/76 PH |
| 4,502,062 | 2/1985 | Künst | 346/155 |
| 4,768,045 | 8/1988 | Koto | 347/19 |
| 4,934,846 | 6/1990 | Gilham | 400/104 |
| 5,065,620 | 11/1991 | Bares | 73/159 |
| 5,255,020 | 10/1993 | Martin et al. | 346/140 R |
| 5,321,436 | 6/1994 | Herbert | 346/140 R |
| 5,457,389 | 10/1995 | Shibata | 324/514 |

FOREIGN PATENT DOCUMENTS

| | | |
|---|---|---|
| 0 257 570 | 3/1988 | European Pat. Off. . |
| OS 37 32 395 | 4/1989 | Germany . |
| OS 40 23 390 | 1/1992 | Germany . |

*Primary Examiner*—Edgar S. Burr
*Assistant Examiner*—Dave A. Ghatt
*Attorney, Agent, or Firm*—Hill & Simpson

[57] ABSTRACT

An arrangement for monitoring the functioning of an ink print head, an enhancement of the functional dependability by enhancing the monitoring precision given reduced outlay is obtained with a constant monitoring and evaluation of the print format, with the brightness of the recording medium having no influence on the monitoring precision. A sensor head with at least two wiper electrodes is placed on the recording medium following the ink print head and is connected to an evaluation circuit that in turn has an output side connected to the drive circuit for the ink print head. Changes in the electrical properties of the recording medium between the wiper electrodes are acquired in the evaluation circuit, these changes arising due to the presence of just-printed ink thereon. The arrangement is suitable for ink print heads operating according to the bubble jet principle as well as for ink print heads with piezo actuators.

5 Claims, 1 Drawing Sheet

ARRANGEMENT FOR MONITORING FUNCTIONING OF AN INK PRINT HEAD

BACKGROUND OF THE INVENTION

1. Field of the Invention

The present invention is directed to an arrangement for monitoring functioning of an ink print head.

2. Description of the Prior Art

Ink print heads are utilized in office printers and, recently, in postage meter machines and product labeling devices as well.

Outages of individual nozzles of an ink print head can arise due to blockage of the nozzle or ink channels with ink particles, blockage of the nozzle apertures with dried ink and/or dust, interruption of the ink capillaries due to the formation of bubbles or rupture of the meniscus, gas inclusions in the ink chamber, or errors in the drive electronics.

These printing outages are not only disturbing in the print image but are critical in the case of print format data relevant to the security systems such as value, date, serial number in postage meter machines. Since a contamination of individual nozzles with dust is possible at any time during operation, a function outage of individual nozzles can even occur immediately following a function test of the ink print head.

There has therefore long been a need for an optimally continual monitoring of ink print heads.

It is known from European applications 0 257 570, 0331 352 and 0 416 849 to drive all print nozzles of an ink print head once per printing pass, so that a line transverse to the feed direction of the mailings arises. Subsequently, this line is sensed with an optical sensor.

Usually, a CCD line sensor is utilized as optical sensor. Given 200 nozzles for example, with a photodiode per nozzle or printing point, a relatively costly arrangement results (also see 0 397 810). Moreover, constant monitoring is not achieved. Additionally, the franking imprint on the recording medium ensues with red ink differing greatly in brightness; consequently, the brightness difference between unprinted and printed recording medium can also differ greatly from case to case. Given a dark-colored recording medium, the difference can be so slight that high demands that can hardly be met are made on the optical sensor.

Further, a device for monitoring ink print heads is known from German OS 40 23 390, wherein an ultrasound sensor registers the sound waves emitted during the printing event and conducts electrical signals corresponding thereto to an evaluation unit. The ultrasound sensor is either arranged on a contact plate that carries the ink print head or is implemented in thin-film technology integrated into the layered structure of the ink print head, if the ink print head is constructed in layers.

Piezo sensors, surface filters or polyphenyl films can be employed as such ultrasound sensors.

The functioning of the individual ink print chamber or nozzle can be determined with this device but it cannot be determined whether the ink drop in fact lands on the recording medium at the assigned location. This means that, as rather frequently occurs, skewed splatters are not covered. Moreover, the evaluation unit becomes more extensive and complicated the fewer ultrasound sensors one wishes to employ.

SUMMARY OF THE INVENTION

An object of the present invention is to enhance the functional dependability of ink print heads by enhancing the monitoring precision given reduced outlay.

Another object of the present invention is to constantly monitor the functioning of an ink print head by evaluating the print format, with the brightness of the recording medium having no influence on the monitoring precision or on the sensitivity of the testing instrument.

The above object is achieved in accordance with the principles of the present invention in an arrangement for monitoring functioning of an ink print head, which produces an inked imprint on a recording medium moving past said ink print head, including a sensor head having at least two wiper electrodes in contact with the moving recording medium following the print head and electrically connected to an evaluation circuit. The wiper electrodes obtain an electrical signal which changes dependent on the electrical properties of the recording medium between the wiper electrodes, due to the presence of the just-printed imprint. The evaluation circuit monitors the functioning of the ink print head dependent on this electrical signal.

The invention is based on two facts that have long been known but which have not been recognized as having utility for monitoring the functioning of an ink print head.

First, an ink that water-based as well as predominantly containing solvents such as glycol is utilized for permanent impressions such as franking imprints.

When ink droplets strike the recording medium, they are immediately absorbed thereby. This is referred to as "ink absorption in the paper". The printing locations are in fact smear-resistant but the bonded ink is still fluid in the recording medium. The conductivity is thus higher in the freshly printed points than in the unprinted locations.

Second, embodiments of thermal print heads are known that have a comb-shaped structure of electrodes at their face side and along which the inking ribbon is conducted in common with the recording medium, see European application 0 067 969 and German OS 32 18 731. As is known, a heat-sensitive inking ribbon from which color parts are designationally transferred onto the recording medium by partial heat application is arranged between recording medium and a thermal print head in the standard thermal printing process.

In another embodiment, see German OS 28 55 631 and German PS 31 43 135, the thermal print head likewise has a write comb, with the electrodes arranged side-by-side on a carrier and in communication with a drive circuit. Inking ribbon and recording medium, however, are combined. Metal particles are partially burned away and a color layer therebeneath is thereby uncovered.

In the inventive solution, the electrodes are placed on the recording medium as sensors or wiper electrodes and the modification of the conductivity between respectively two electrodes is acquired in a following evaluation circuit.

A change in capacitance can alternatively be measured instead of the change in resistance.

Analogous to the thermal print head, the wiper electrodes are combined to form a sensor head and are provided with corresponding control circuits.

The sensor head is arranged following the ink print head in the conveying direction of the recording medium. The spacing between sensor head and ink print head is selected such that the ink has just been absorbed in the recording medium. I.e., the printed points, are smear-resistant but not yet completely dried.

Characteristic of the print formats to be tested is that they create a closed connection between the wiper contacts.

By means of the arrangement of the wiper contacts at different locations, such as in a wiper electrode comb with different gaps, with different widths and in different numbers as well as at different spacings from one another, the error tolerance of the sensor can be modified.

One embodiment of the invention strives to provide as many wiper contacts as possible—a maximum of one more wiper contact than nozzles in the ink print head—and, under processor control, controlling the point in time of the measurement between two entirely different pairs of wiper contacts dependent on the type of printing information. The simultaneous interrogation of a plurality of wiper contact pairs is also possible.

A further advantage of the inventive arrangement is that, due to the resilient wiper electrodes, a constant self-cleaning of the sensor head ensues and contamination of the contacts is avoided.

An automatic null balance with reference to the particular recording medium utilized, in its dry state, is possible before the beginning of each measurement.

The arrangement is equally well-suited for all ink printing technologies such as bubble jet, piezo, continuous.

The illustration is schematic for simplification and to facilitate understanding.

DESCRIPTION OF THE PREFERRED EMBODIMENTS

Figure 1:
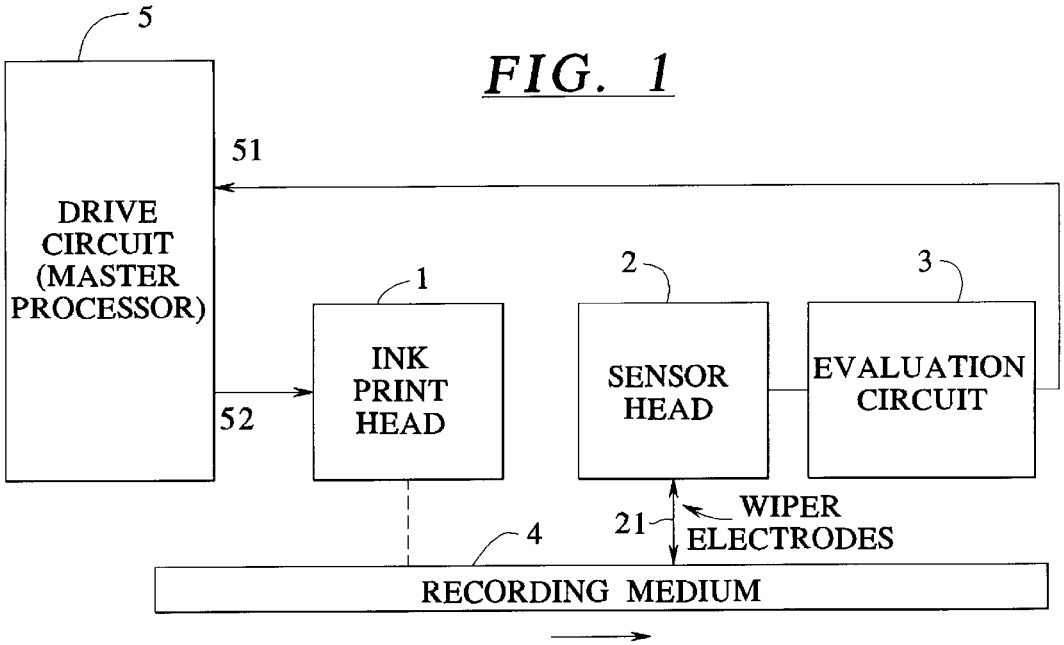
FIG. 1 is a block circuit diagram of an arrangement with an ink print head and a print format evaluation arrangement constructed in accordance with the principles of the present invention.

As shown in FIG. 1, an ink print head 1 is driven by a drive circuit 5. Corresponding to the drive data forwarded from an output 52, the ink print head 1 generates printed points or a pattern of printed points on a recording medium 4, each printed point having a diameter following "recording medium 4".

The recording medium is sensed with a sensor head 2 having wiper electrodes 21 in the printing region following the ink print head 1. The wiper electrodes 21 are resiliently, non-fixedly placed against the recording medium 4. The changes in the electrical properties—conductance, dielectric constant—between two wiper electrodes 21 are forwarded as electrical signals to an evaluation circuit 3 connected to the sensor head 2 and are evaluated therein. The result of the evaluation is conducted to the drive circuit 5 for the ink print head 1 and is compared therein to the printing pulse pattern that triggered the sensed impression. If the result of the comparison exhibits deviations beyond an allowable amount, the printing event is inhibited and a cleaning cycle is initiated for the ink print head. A switch back to printing mode with monitoring is made thereafter. If inadmissibly great deviations continue to occur, then the printer arrangement is entirely inhibited. The executive sequence control ensues by the drive circuit 5 that contains a master processor.

Figure 2:
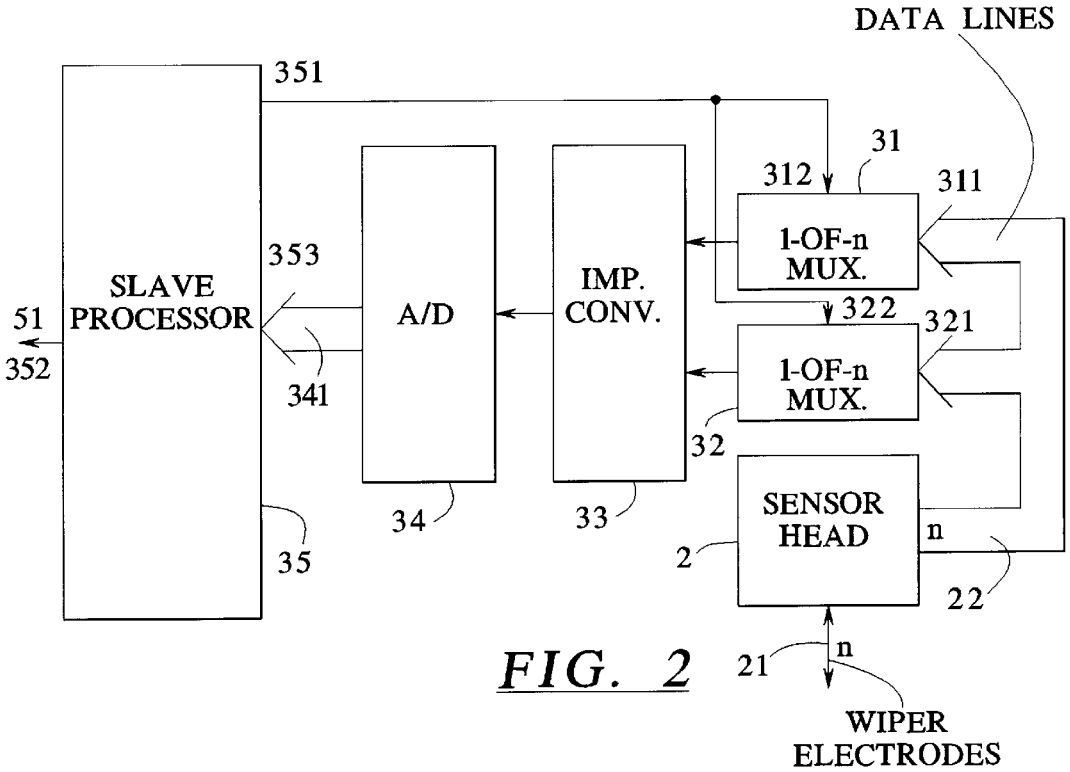
FIG. 2 is a detailed block circuit diagram of the print format evaluation arrangement constructed in accordance with the principles of the present invention.

As shown in FIG. 2, the sensor head 2 is provided with n wiper electrodes 21 and n outputs 22. The outputs 22 are connected to first inputs 311 of a first "1-of-n" multiplexer 31 and to first inputs 321 of a second "1-of-n" multiplexer 32. The respective second inputs 312 and 322 of the multiplexers 31 and 32 are connected in common to a multiplex control output 351 of a slave processor 35. Controlled by the slave processor 35, selected, first inputs 311 and 321 of multiplexers 31 and 32 are respectively activated and the output signal is thereby taken i.e., two of the 1 through n outputs 22 of the sensor head 2 are interrogated.

When there is a need to simultaneously evaluate two or more of printing points, then four or correspondingly more "1-of-n" multiplexers are required therefor.

The two multiplexers 31 and 32 are followed by a common impedance converter 33 that is in turn connected to inputs 353 of the slave processor 35 via an A/D converter 34 and following data lines. The slave processor 35 has an output 352 interconnected to a control input 51 of the drive circuit.

As the above comments make clear, a sensor head 2 can be minimally equipped with two wiper electrodes that can be arranged at the outer region of the imprint or at the especially relevant inner region of the imprint. This is up to discretion, since skewed splatters can interrupt the printing line between two electrodes and then be interpreted as an error. In general, the wiper electrodes have a spacing therebetween in a range between a minimum spacing equal to the diameter of a printing point, and a maximum spacing equal to a longest line formed between two printing points transverse to a moving direction of the recording medium during printing.

Although modifications and changes may be suggested by those skilled in the art, it is the intention of the inventors to embody within the patent warranted hereon all changes and modifications as reasonably and properly come within the scope of their contribution to the art.

We claim as our invention:

1. An arrangement for monitoring functioning of an ink print head which produces an inked imprint on a recording medium moving past said ink print head, said arrangement comprising:

an ink print head:

a sensor head having at least two wiper electrodes disposed in contact with a recording medium following said ink print head, said wiper electrodes obtaining an electrical signal which changes dependent on electrical properties of a recording medium between the wiper electrodes caused by a presence of a just-printed imprint on a recording medium; and evaluation means, supplied with said electrical signal, for determining whether said ink print head is functioning properly dependent on said changes in said electrical signal.

2. An arrangement as claimed in claim 1 wherein said ink print head produces a plurality of printing points comprising an inked imprint, each printing point having a diameter, and wherein said wiper electrodes have a spacing therebetween in a range between a minimum spacing equal to said diameter of a printing point, and a maximum spacing equal to a longest line formed between two printing points transverse to a moving direction of a recording medium during printing.

3. An arrangement as claimed in claim 1 wherein said ink print head has a plurality of ink-ejecting nozzles from which ink is ejected to produce an inked imprint, and wherein a number of said wiper contacts is greater than said plurality of nozzles.

4. An arrangement as claimed in claim 1 wherein said ink print head includes a drive circuit for operating said ink print head, and said arrangement further comprising control means for operating said drive circuit dependent on a determination of whether said ink print head is functioning properly made by said evaluation means.

5. An arrangement as claimed in claim 4 wherein said drive circuit includes a master processor, and said arrangement further comprising:

said sensor head having n wiper electrodes and n data lines respectively connected thereto;

at least two 1-of-n multiplexors, each 1-of-n multiplexor having first control inputs connected to said n data lines of said sensor head, a second control input, and an output;

an impedance converter connected to the respective outputs of each of said one of n multiplexors and having an impedance converter output;

an analog-to-digital converter having an input connected to said impedance converter output and having an analog-to-digital converter output; and a slave processor, subservient to said master processor, having an input connected to said analog-to-digital converter output and including means for generating control signals respectively supplied to said second control inputs of said 1-of-n multiplexors.

* * * * *